US006105284A

United States Patent [19]

Wu

[11] Patent Number: 6,105,284

[45] Date of Patent: Aug. 22, 2000

[54] METHOD OF FABRICATING PATTERNED ZIPPER TAPES AND APPARATUS FOR IRONING THE PATTERNED ZIPPER TAPES

[75] Inventor: Nai-Chin Wu, Taipei, Taiwan

[73] Assignee: Meng-Hsin Yang, Taipei, Taiwan

[21] Appl. No.: 09/093,863

[22] Filed: Jun. 9, 1998

[51] Int. Cl.[7] ..... D06F 69/02; D04B 7/16

[52] U.S. Cl. ..... 38/47; 66/202

[58] Field of Search ..... 38/44, 47, 45, 38/56, 60, 61; 112/470.33, 475.16, 406; 66/202, 180; 29/408, 410; 24/392, 393, 395; 428/219; 28/171.2, 178, 179, 184, 210; 57/287

[56] References Cited

U.S. PATENT DOCUMENTS

| | | | |
|---|---|---|---|
| 1,707,056 | 3/1929 | Fischer et al. | 38/60 |
| 2,673,410 | 3/1954 | Jones et al. | 38/61 |
| 3,657,904 | 4/1972 | Austin et al. | 112/475.16 X |
| 3,685,474 | 8/1972 | Frohlich et al. | 112/475.16 X |
| 5,417,249 | 5/1995 | Kato | 24/393 X |
| 5,582,903 | 12/1996 | Levy et al. | 428/219 |
| 5,823,012 | 10/1998 | Hacskaylo | 66/180 X |

*Primary Examiner*—Ismael Izaguirre
*Attorney, Agent, or Firm*—Varndell & Varndell, PLLC

[57] ABSTRACT

A patterned zipper tape fabrication method including the steps of (1) preparing warp yarns and weft yarns, (2) using a jacquard knitting machine to knit the prepared warp yarns and weft yarns into patterned zipper tapes each having a cord along one side edge and a trademark and/or a logo, and (3) using a zipper tape ironing apparatus to iron patterned zipper tapes being transferred from said jacquard knitting machine. The invention relates also to the zipper tape ironing apparatus used in the patterned zipper tape fabrication method.

3 Claims, 9 Drawing Sheets

METHOD OF FABRICATING PATTERNED ZIPPER TAPES AND APPARATUS FOR IRONING THE PATTERNED ZIPPER TAPES

BACKGROUND AND SUMMARY OF THE INVENTION

The present invention relates to a method of fabricating patterned zipper tapes which includes the step of preparing warp yarns and weft yarns, the step of knitting the prepared warp yarns and weft yarns into patterned zipper tapes, and the step of ironing patterned zipper tapes. The invention relates also to a zipper tape ironing apparatus used in the patterned zipper tape fabrication method.

A knitted zipper tape has a cord along one side edge on which a series of plastic teeth is molded by an injection-molding machine. When a zipper is stitched to a satchel, garment, sports shoes, cloth wardrobe, hand bag, etc., a cover flap may be provided to conceal the zipper from sight. If the zipper of a device bears a trademark or logo of a company, it is not necessary to conceal the zipper from sight. Various jacquard knitting machines are known capable of knitting warp yarns and weft yarns into patterned zipper tapes each having a trademark and/or a logo on it. However, the cords of patterned zipper tapes tend to be damaged when patterned zipper tapes are transferred out of the jacquard knitting machine. Because of the aforesaid problem, zipper tape manufacturers usually make a trademark or logo on zipper tapes by printing. However, the printed trademark or logo of a zipper tape fades soon.

The present invention has been accomplished under the circumstances in view. It is the main object of the present invention to provide a patterned zipper tape fabrication method which is practical for fabricating patterned zipper tapes each having a cord along one side for the molding of a series of plastic teeth thereon. It is another object of the present invention to provide a patterned zipper tape fabrication method which knits warp yarns and weft yarns into patterned zipper tapes, and automatically iron knitted patterned zipper tapes. According to the present invention, the patterned zipper tape fabrication method includes the steps of (1) preparing warp yarns and weft yarns, (2) using a jacquard knitting machine to knit the prepared warp yarns and weft yarns into patterned zipper tapes each having a cord along one side edge and a trademark and/or a logo, and (3) using a zipper tape ironing apparatus to iron patterned zipper tapes being transferred from said jacquard knitting machine. According to another aspect of the present invention, annular grooves are provided at the periphery of the zipper tape-transfer cylinder, guide cylinder and guide rollers of jacquard knitting machine for guiding the cords of patterned zipper tapes to prevent the cords of patterned zipper tapes from being damaged. According to still another aspect of the present invention, the zipper tape ironing apparatus uses an air cylinder to move an ironing board assembly relative to an ironing cylinder, so that patterned zipper tapes which are transferred from the jacquard knitting machine through the gap in between the ironing cylinder and the ironing board are automatically ironed during the operation of the jacquard knitting machine, and the ironing board assembly is automatically moved away from the ironing cylinder when the jacquard knitting machine is stopped. A patterned zipper tape made according to the present invention has a trademark and/or a logo on it, therefore it is not necessary to conceal the patterned zipper tape from sight when the patterned zipper tape is stitched to a device.

DETAILED DESCRIPTION OF THE PREFERRED EMBODIMENT

Referring to FIGS. from 1 to 6, a patterned zipper tape fabrication method in accordance with the present invention comprises the steps of:

I. Preparing materials:

i) preparing warp yarn by:

a) selecting TETORON® (a registered trademark for a synthetic polyester fiber) or rayon fibers;

b) twisting tetoron or rayon fibers into tetoron or rayon threads at about 360–500 runs per meter;

c) vacuum-setting the polyester or rayon threads at 80° C. for 30 minutes, and then repeating the vacuum-setting process;

d) stretching the polyester or rayon threads to reach hardness 35; hardness 35 used in the present invention is the same as that achieved in the prior art;

e) dying the polyester or rayon threads with dispersing dye at about 120–135° C. for about 30–45 minutes;

f) dehydrating the well-dyed polyester or rayon threads;

g) doubling the polyester or rayon threads into the desired warp yarns having the hardness of 70; hardness 70 used in the present invention is the same as that achieved in the prior art.

ii) preparing weft yarn by:

a) selecting polyester or rayon fibers;

b) twisting polyester or rayon fibers into tetoron or rayon threads at about 360–500 runs per meter;

c) vacuum-setting the polyester or rayon threads at 80° C. for 30 minutes, and then repeating the vacuum-setting process;

e) dying the polyester or rayon threads with dispersing dye at about 120–135° C. for about 30–45 minutes;

f) dehydrating the well-dyed polyester or rayon threads;

f) doubling the polyester or rayon threads into the desired weft yarns having the hardness of 70; hardness 70 as used in the present invention is the same as that achieved in the prior art.

Figure 2:
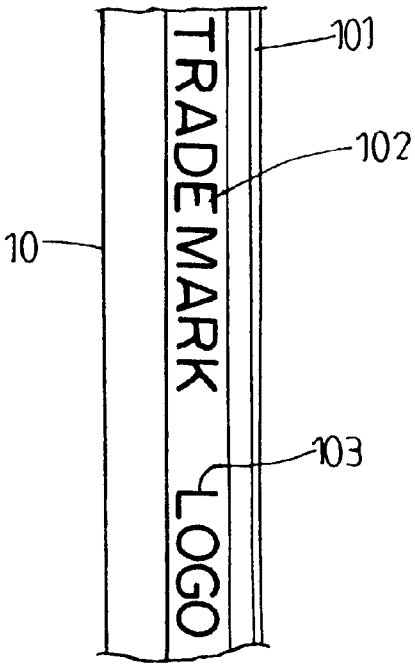
FIG. 2 is a plain view of a patterned zipper tape made according to the present invention.
Figure 4:
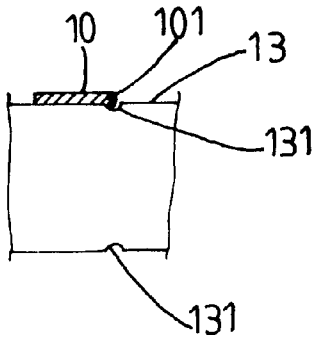
FIG. 4 is a plain view of a part of the guide cylinder of the jacquard knitting machine according to the present invention.

II. Knitting the desired patterned zipper tapes by:

using a jacquard knitting machine 1 (see FIG. 12) to knit the prepared warp yarns and weft yarns into the desired patterned zipper tapes 10 each having a cord 101 along one side edge and a trademark 102 and/or a logo 103 (see FIG. 2).

III. Ironing the patterned zipper tapes 10 thus obtained through a knitted fabric ironing apparatus.

Figure 1:
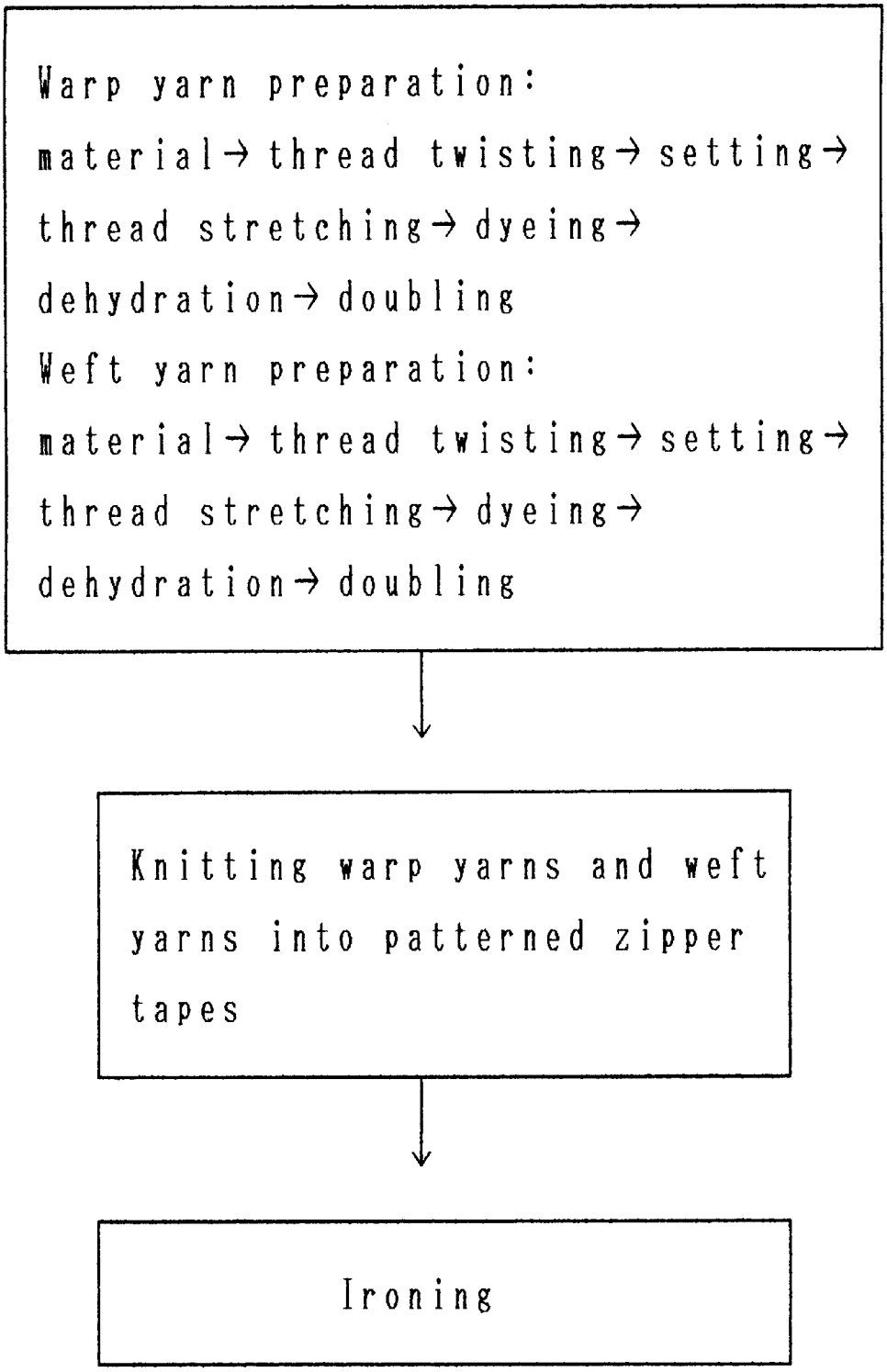
FIG. 1 is a block diagram explaining the patterned zipper taper fabrication method of the present invention.
Figure 3:
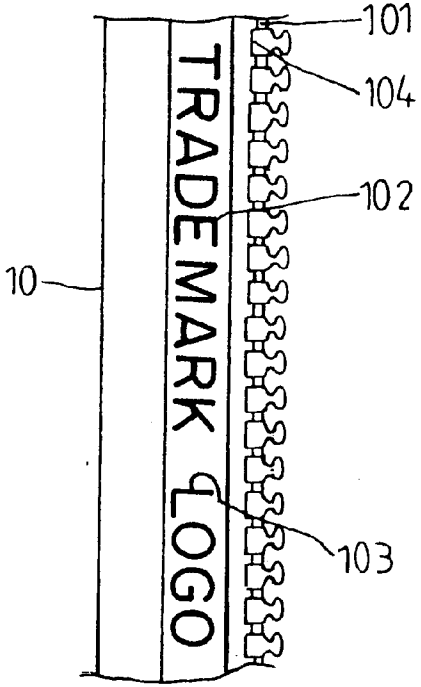
FIG. 3 is similar to FIG. 2 but showing a series of plastic teeth molded on the cord of the patterned zipper tape.

A patterned zipper tape 10 made according to the aforesaid fabrication method has a cord 101 along one side edge to which a row of plastic teeth 104 is molded, a trademark 102 and/or logo 103 on it (see FIG. 3). This structure of patterned zipper tape 10 is practical for use in garment, bags, satchels, cloth wardrobes, sports shoes, etc.

Figure 5:
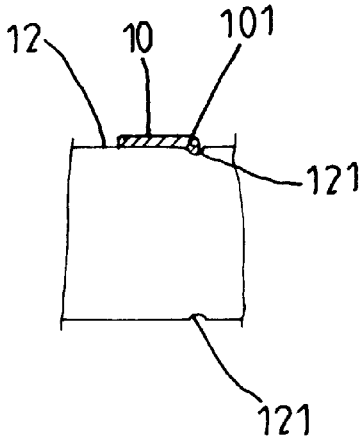
FIG. 5 is a plain view of a part of the zipper tape-transfer cylinder of the jacquard knitting machine according to the present invention.
Figure 12:
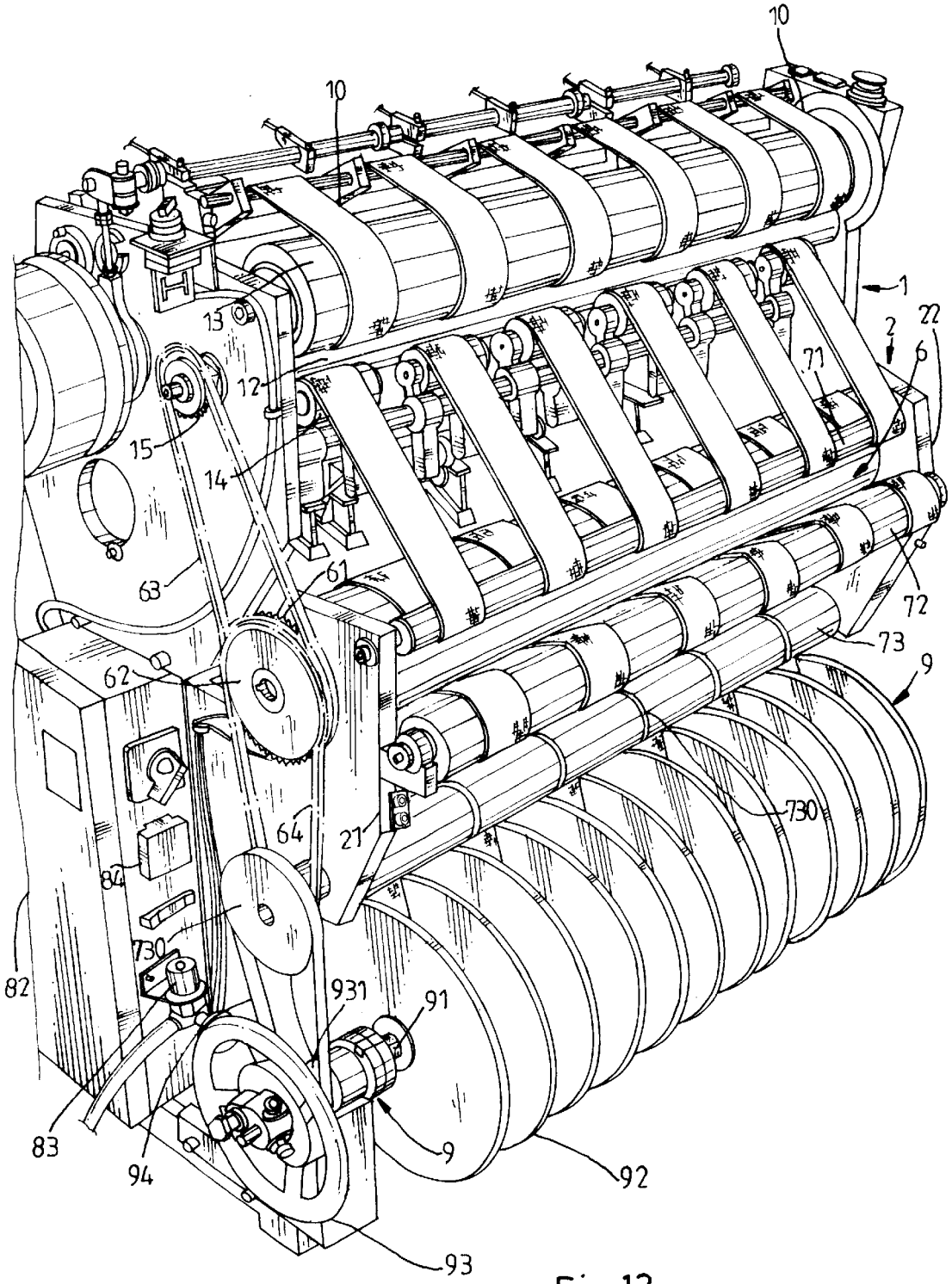
FIG. 12 is a perspective view of the jacquard knitting machine and the zipper tape ironing apparatus according to the present invention.

The zipper tape-transfer cylinder 12 of the jacquard knitting machine 1 used in the aforesaid patterned zipper tape fabrication method has a plurality of annular grooves 121 around the periphery for guiding the cords 101 of the knitting patterned zipper tapes 10 when the knitted patterned zipper tapes 10 are delivered out of the jacquard knitting machine 1 (see FIGS. 5 and 12). The guide cylinder 13 has a plurality of annular grooves 131 around the periphery corresponding to the annular grooves 121 on the zipper tape-transfer cylinder 12 for guiding the cords 101 of the patterned zipper tapes 10 (see FIGS. 6 and 15). Similarly, the guide rollers 14 each have an annular groove 141 around the periphery for guiding the cords 101 of the knitted patterned zipper tapes 10 (see FIGS. 6 and 12).

The aforesaid knitted fabric ironing apparatus comprises a base frame 2, an air cylinder 3, a swivel arm 41, a pivot 42, two rocker arms 43, an ironing board assembly 5, an ironing cylinder 6, two guide rolls 71; 72, a zipper tape-transfer cylinder 73, an impression cylinder 74, a temperature detector 81, and a control box 82.

Figure 15:
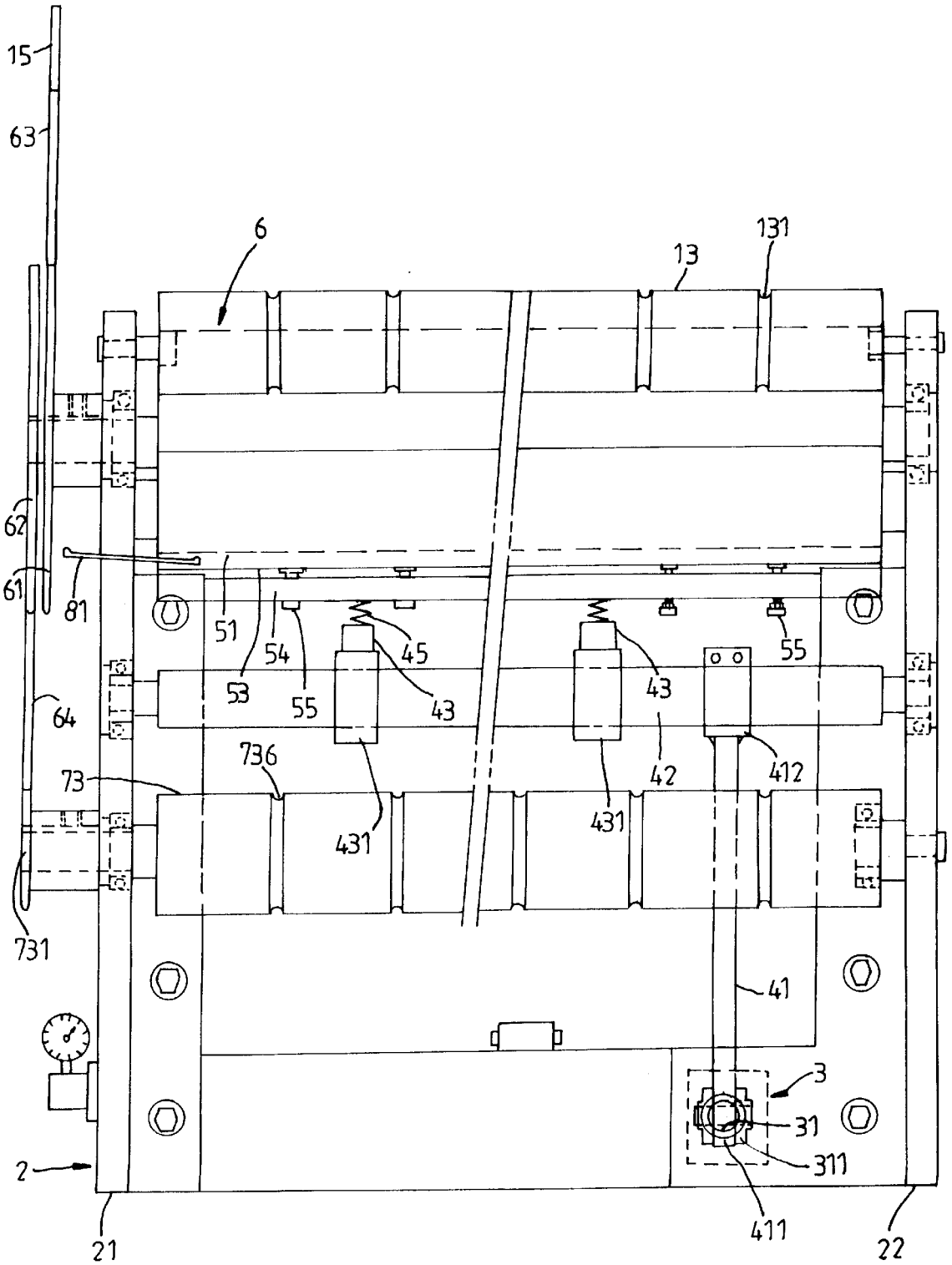
FIG. 15 is a front plain view of the zipper tape ironing apparatus according to the present invention.
Figure 16:
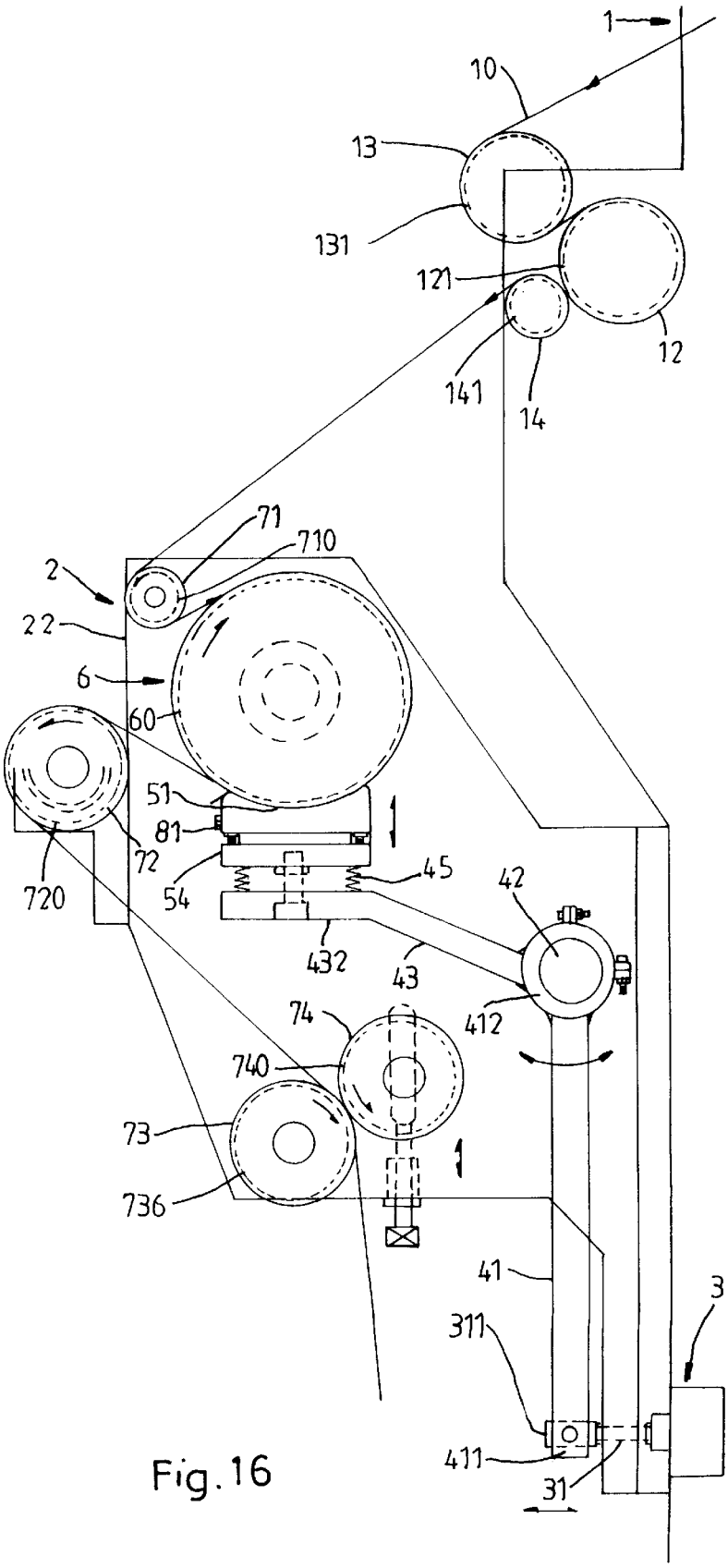
FIG. 16 is a side plain view of the zipper tape ironing apparatus and a part of the jacquard knitting machine according to the present invention.

The base frame 2 comprises two upright side panels 21; 22 disposed in parallel in front of the jacquard knitting machine 1 (see FIG. 12) to hold the pivot 42, the ironing cylinder 6, the guide rolls 71; 72, the zipper tape-transfer cylinder 73 and the impression cylinder 74 therebetween (see FIGS. 15 and 16).

Figure 6:
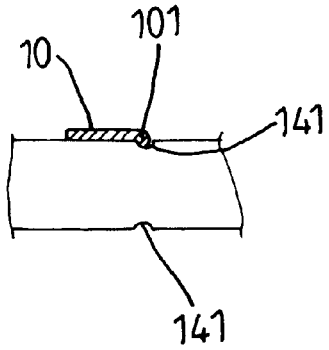
FIG. 6 is a plain view of a part of one guide roller of the jacquard knitting machine according to the present invention.
Figure 13:
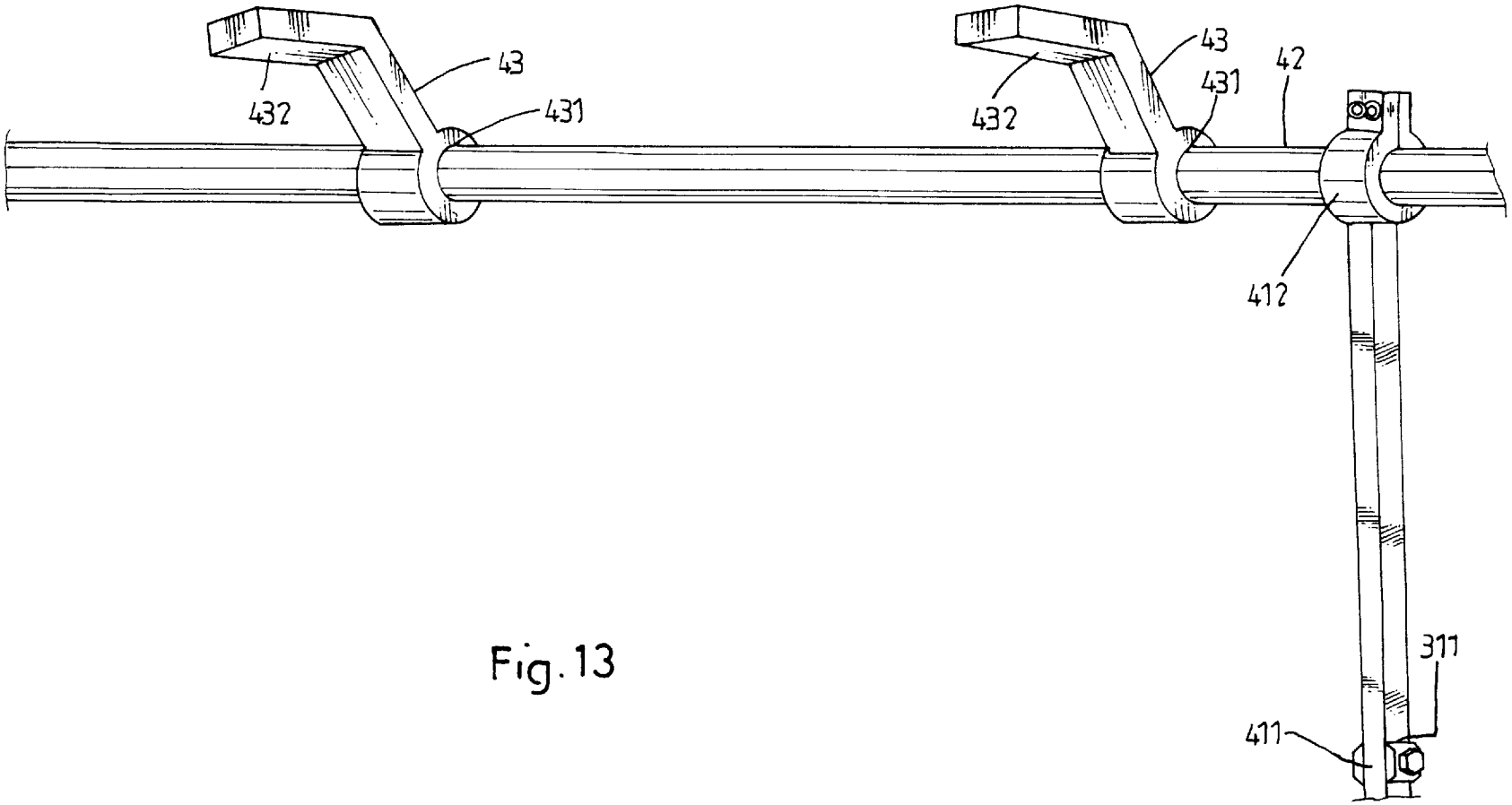
FIG. 13 is an enlarged view of a part of the zipper tape ironing apparatus showing the swivel arm and the rocker arms connected to the pivot according to the present invention.

The air cylinder 3 is fixedly mounted on one upright side panel 22 of the base frame 2, having a connector 311 at the outer end of the piston rod 31 thereof for connection to the seivel arm 41 (see FIGS. 13 and 6).

The swivel arm 41 has a bottom end 411 pivoted to the connector 311 at the outer end of the piston rod 31 of the air cylinder 3, and a top end 412 fixedly fastened to the pivot 42 (see FIGS. 13 and 16).

The pivot 42 is revolvably supported between the upright side panels 21; 22 of the base frame 2, and turned back and forth with the swivel arm 41 (see FIG. 16).

Figure 14:
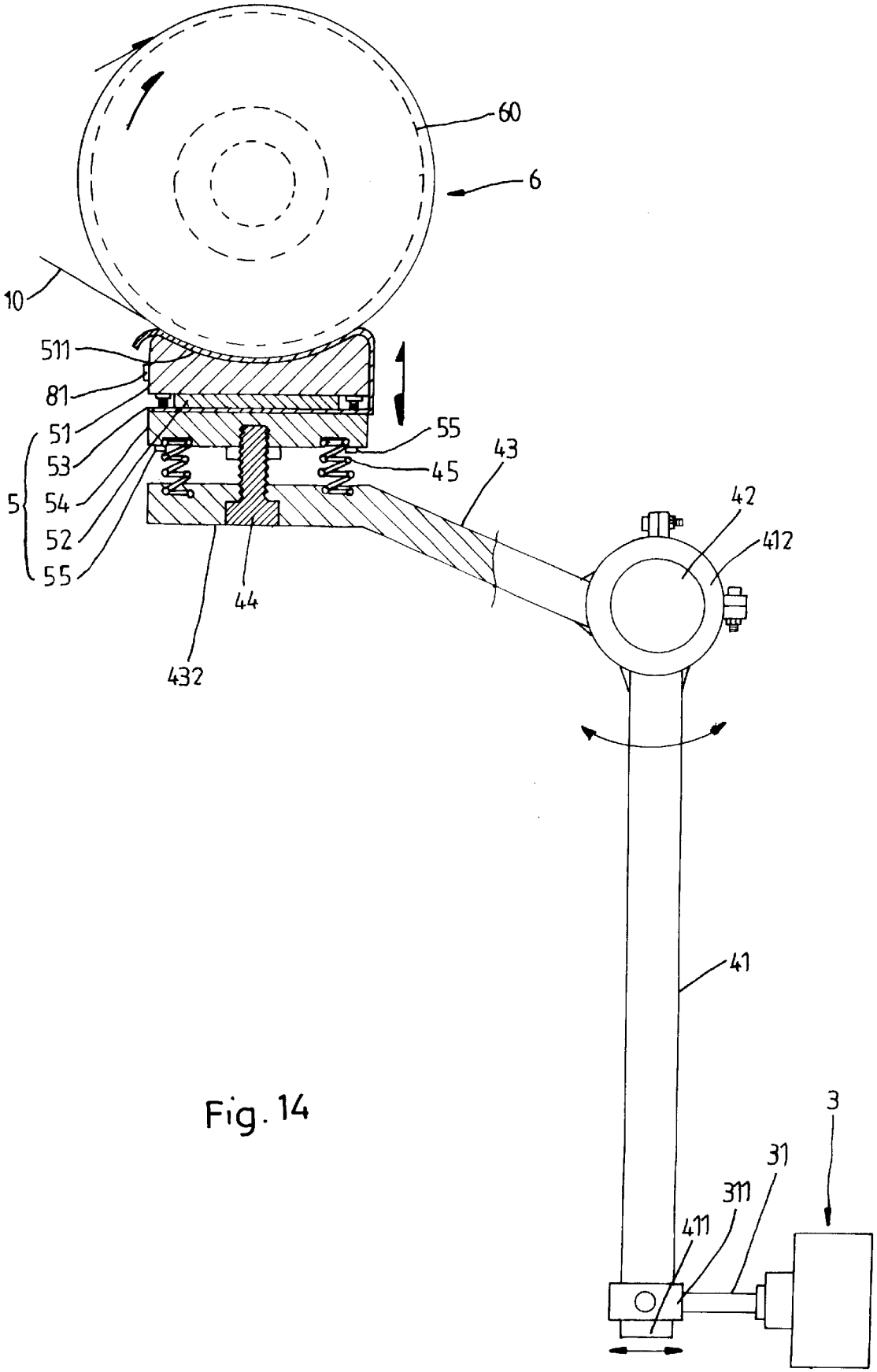
FIG. 14 is a sectional view of a part of the zipper tape ironing apparatus showing the ironing board assembly coupled to the rocker arms according to the present invention.

The rocker arms 43 are arranged in parallel, each having an inner end 431 fixedly connected to the pivot 42 and an outer end 432 coupled to the ironing board 5 by a screw bolt 44 (see FIGS. 13, 14 and 16).

The ironing board assembly 5 comprises an ironing board 51 having a concave top side wall 511 fitting the periphery of the ironing cylinder 6, a heating plate 52 attached to the bottom side of the ironing board 51 opposite to the ironing cylinder 6, a heat conductive cloth 53 covered over the ironing board 51 and the heating plate 52, and a bottom board 54 attached to the heat conductive cloth 53 below the heating plate 52 and fastened to the ironing board 51 by screws 55, enabling the heating plate 52 to be retained between the ironing board 51 and the bottom board 54 (see FIG. 14). The bottom board 54 of the ironing board assembly 5 is coupled to the outer ends 432 of the roacker arms 43, and supported on spring members 45 above the outer ends 432 of the rocker arms 43 (see FIG. 14).

The ironing cylinder 6 is revolvably supported between the upright side panels 21;22 of the base frame 2, comprising a plurality of annular grooves 60 around the periphery for guiding the cords 101 of the knitted patterned zipper tapes 10 transferred from the jacquard knitting machine 1, a first chain wheel 61 and a second chain wheel 62 fixedly mounted on one end thereof outside one upright side panel 21, a first chain 63 coupled between the first chain wheel 61 and a chain wheel 15 at one end of a zipper tape-transfer cylinder 12 of the jacquard knitting machine 1, and a second chain 64 coupled between the second chain wheel 62 and the zipper tape-transfer cylinder 73 (see FIGS. 8, 12, 15 and 16).

Figure 7:
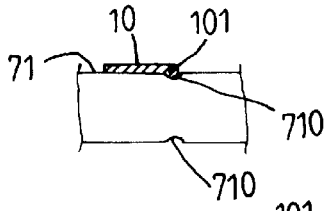
FIG. 7 is a plain view of a part of the upper guide roll of the zipper tape ironing apparatus according to the present invention.
Figure 8:
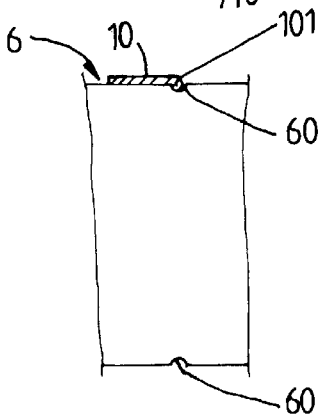
FIG. 8 is a plain view of a part of the ironing cylinder of the zipper tape ironing apparatus according to the present invention.
Figure 9:
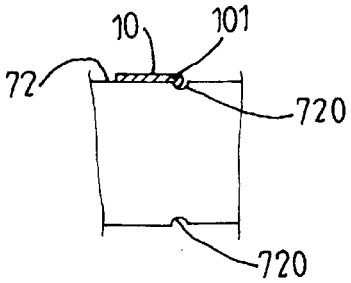
FIG. 9 is a plain view of a part of the lower guide roll of the zipper tape ironing apparatus according to the present invention.

The guide rolls 71; 72 are revolvably supported between the upright side panels 21;22 of the base frame 2 at different elevations adjacent to the ironing cylinder 6, each having a plurality of annular grooves 710;720 around the periphery for guiding the cords 101 of the knitted patterned zipper tapes 10 transferred from the jacquard knitting machine 1 (see FIGS. 7, 12 and 16). The upper guide roll 71 guides knitted patterned zipper tapes 10 from the zipper tape-transfer cylinder 12 of the jacquard knitting machine 1 to the ironing cylinder 6. The lower guide roll 72 guides knitted patterned zipper tapes 10 out of the ironing cylinder 6 toward the zipper tape-transfer cylinder 73 and the impression cylinder 74 (see FIGS. 7, 9 and 16).

Figure 10:
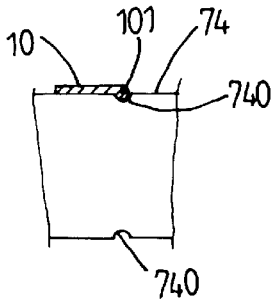
FIG. 10 is a plain view of a part of the impression cylinder of the zipper tape ironing apparatus according to the present invention.
Figure 11:
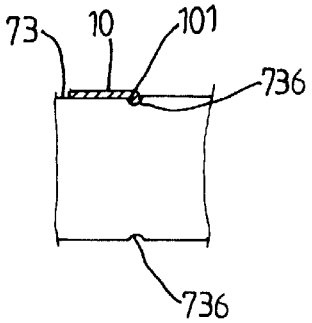
FIG. 11 is a plain view of a part of the zipper tape-transfer cylinder of the zipper tape ironing apparatus according to the present invention.

The zipper tape-transfer cylinder 73 and the impression cylinder 74 are revolvably supported between the upright side panels 21;22 of the base frame 2 below the oscillating arms 43, each having a plurality of annular grooves 736; 740 around the periphery for guiding the cords 101 of patterned zipper tapes 10 transferred from the lower guide roll 72 when knitted patterned zipper tapes 10 are delivered in between the zipper tape-transfer cylinder 73 and the impression cylinder 74 (see FIGS. 10, 11 and 16). The zipper tape-transfer cylinder 73 has one end fixedly mounted with a sprocket wheel 731, which is coupled to the second chain wheel 62 of the ironing cylinder 6 by the second chain 64 (see FIG. 15).

The temperature detector 81 is mounted on the ironing board 51 of the ironing board assembly 5 to detect the temperature of the ironing board 51, and to send a signal to the control box 82 subject to its detecting result (see FIGS. 14 and 12).

The control box 82 comprises a pressure gauge 83 and a temperature control device 84.

When the apparatus is started, the temperature of the heating plate 52 is increased to a predetermined value, and the temperature detector 81 detects the temperature of the ironing board 51 and sends a corresponding signal to the temperature control device 84 for comparison with a pre-set reference value, enabling the temperature control device 84 to control the temperature of the heating plate 52 within a predetermined range. When the temperature of the ironing board 51 reaches the predetermined range, the jacquard knitting machine 1 is started to knit the warp yarns and weft yarns into patterned zipper tapes 10, and at the same time the piston rod 31 of the air cylinder 3 is extended out to move the swivel arm 41 forwards to a high position, thereby causing the rocker arms 43 to be turned upwards. When the rocker arms 43 are turned upwards the ironing board assembly 5 is lifted to force the ironing board 51 against patterned zipper tapes 10 being transferred over the ironing cylinder 6 (see FIGS. 14 and 16). On the contrary, when the jacquard knitting machine 1 is stopped, the piston rod 31 of the air cylinder 3 is received back to turn the swivel arm 41 in the reversed direction, thereby causing the rocker arms 43 to be turned downwards. When the rocker arms 43 are turned downwards, the ironing board assembly 5 is lowered to move the ironing board 51 away from the ironing cylinder 6.

Further, a zipper tape take up mechanism 9 is coupled to the base frame 2 at the front side to take up finished patterned zipper tapes 10. The zipper tape take up mechanism 9 comprises a revolving shaft 91 revolvably supported between the upright side panels 21; 22 of the base frame 1, a plurality of reels 92 fixedly mounted around the revolving shaft 91 and turned with the revolving shaft 91 to take up patterned zipper tapes 10 from the zipper tape-transfer cylinder 73, a hand wheel 93 fixedly mounted on one end of the revolving shaft 91, a belt wheel 931 fixedly mounted on the revolving shaft 91 adjacent to the hand wheel 93, and a transmission belt 94 coupled between the belt wheel 931 at the revolving shaft 91 and a belt wheel 730 at one end of the zipper tape-transfer cylinder 73.

What is claimed is:

1. A patterned zipper tape fabrication method comprising a first step of preparing warp yarns and weft yarns, a second step of knitting the prepared warp and weft yarns using a jacquard knitting machine into patterned zipper tapes each having a cord along one side edge and a trademark and/or a logo, and a third step of ironing the patterned zipper tapes using a zipper tape ironing apparatus by passing the patterned zipper tapes between a heated ironing board and a roller, the first step of preparing warp yarns and weft yarns including the preparation warp yarns by sub-steps of:

a) selecting fibers from the group consisting of polyester and rayon, b) twisting said fibers respectively into threads from the group consisting of polyester and rayon threads at about 360–500 run per meter, c) vacuum-setting said threads at 80° C. for 30 minutes and then repeating the vacuum-setting process, d) stretching said threads to reach a hardness of 35, e) dying said threads with dispersing dye at about 120–135° C. for about 30–45 minutes, f) dehydrating the dyed threads, and g) doubling said threads into desired warp yarns having a hardness of 70; and the first step of preparing warp yarns and weft yarns also including the preparation weft yarns by sub-steps of:

a) selecting a fiber from the group consisting of polyester and rayon, b) twisting said fibers respectively into threads from the group consisting of into polyester and rayon threads at about 360–500 run per meter, c) vacuum-setting said threads at 80° C. for 30 minutes and then repeating the vacuum-setting process, d) stretching said threads to reach hardness of 35, e) dying said threads with dispersing dye at about 120–135° C. for about 30–45 minutes, f) dehydrating the dyed threads, and g) doubling said threads into the desired weft yarns having the hardness of 70.

2. The patterned zipper tape fabrication method of claim 1 wherein said jacquard knitting machine comprises a zipper tape-transfer cylinder for transferring knitted patterned zipper tapes out of said jacquard knitting machine to said zipper tape ironing apparatus, the zipper tape-transfer cylinder of said jacquard knitting machine having a plurality of annular grooves around the periphery for guiding the cords of patterned zipper tapes being transferred.

3. An apparatus for performing the patterned zipper fabricated method according to clam 1, comprising:

a base frame having two upright side panels disposed in parallel in front of said jacquard knitting machine;

an air cylinder fixedly mounted on one upright side panel of said base frame, said air cylinder having a piston rod and a connector at an outer end of said piston rod;

a pivot revolvably supported between said upright side panels of said base frame;

a swivel arm having a bottom end pivoted to the connector at the piston rod of said air cylinder and a top end fixedly fastened to said pivot, said swivel arm being moved with the piston rod of said air cylinder to turn said pivot;

two rocker arms arranged in parallel, said rocker arms each having an inner end fixedly connected to said pivot and an outer end coupled to an ironing board assembly;

an ironing cylinder revolvably supported between said upright side panels of said base frame, said ironing cylinder comprising a plurality of annular grooves around the periphery for guiding the cords of patterned zipper tapes being transferred from said jacquard knitting machine, a first chain wheel and a second chain wheel fixedly mounted on one end thereof outside, a first chain coupled between said first chain wheel and a chain wheel at one end of a zipper tape-transfer cylinder of said jacquard knitting machine, and a second chain coupled between said second chain wheel and a zipper tape-transfer cylinder;

an ironing board assembly mounted on said rocker arms and lifted by said rocker arms to press on said ironing cylinder so as to iron patterned zipper tapes being transferred from said jacquard knitting machine, said ironing board assembly comprising an ironing board having a concave top side wall fitting the periphery of said ironing cylinder, a heating plate attached to said ironing board at a bottom side, a heat conductive cloth covered over said ironing board and said heating plate, and a bottom board attached to said heat conductive cloth below said heating plate and fastened to said ironing board by screws, enabling said heating plate to be retained between said ironing board and said bottom board, said bottom board being coupled to the outer ends of said rocker arms and supported on spring members above the outer ends of said rocker arms;

an upper guide roll and a lower guide roll revolvably supported between said upright side panels of said base frame at different elevations adjacent to said ironing cylinder, said upper guide roll and said lower guide roll each having a plurality of annular grooves around the periphery for guiding the cords of patterned zipper tapes being transferred from said jacquard knitting machine, said upper guide roll guiding patterned zipper tapes from said jacquard knitting machine to said ironing cylinder, said lower guide roll guiding patterned zipper tapes out of said ironing cylinder toward a zipper tape-transfer cylinder;

a zipper tape-transfer cylinder and an impression cylinder revolvably supported between said upright side panels of said base frame below said oscillating arms, each having a plurality of annular the periphery for guiding the cord of patterned zipper tapes being transferred from said lower guide roll, said zipper tape-transfer cylinder and said impression cylinder being disposed in contact with each other and rotated to transfer patterned zipper tapes being transferred from said lower guide roll, the zipper tape-transfer cylinder of said zipper tape ironing apparatus having one end fixedly mounted with a sprocket wheel, which is coupled to the second chain wheel of said ironing cylinder by said second chain;

a temperature detector mounted on said ironing board of said ironing board assembly to detect the temperature of said ironing board and to provide an output signal subject to the detection result; and a control box connected to said temperature detector to receive output signal from said temperature detector, and to control the temperature of said heating plate subject to the output signal of said temperaturer detector.

* * * * *